US008186248B1

(12) United States Patent
Considine

(10) Patent No.: US 8,186,248 B1
(45) Date of Patent: May 29, 2012

(54) HIGH SPEED EXTENSION BREAKER BAR

(76) Inventor: Daniel Considine, Quitman, GA (US)

( * ) Notice: Subject to any disclaimer, the term of this patent is extended or adjusted under 35 U.S.C. 154(b) by 313 days.

(21) Appl. No.: 12/655,175

(22) Filed: Dec. 24, 2009

Related U.S. Application Data

(60) Provisional application No. 61/215,037, filed on May 1, 2009.

(51) Int. Cl.
*B25B 23/16* (2006.01)
*B25G 1/06* (2006.01)

(52) U.S. Cl. ..... 81/177.3; 81/177.9

(58) Field of Classification Search ..... 81/177.3, 81/177.6, 177.7, 177.8, 177.9
See application file for complete search history.

(56) References Cited

U.S. PATENT DOCUMENTS

| | | | | |
|---|---|---|---|---|
| 6,119,559 | A | 9/2000 | Zerver | |
| 6,186,033 | B1 | 2/2001 | Faro, Sr. | |
| 6,382,058 | B1 | 5/2002 | Owoc | |
| 7,509,892 | B2 * | 3/2009 | Hsieh | 81/177.6 |
| 2002/0078800 | A1 | 6/2002 | Li | |
| 2008/0307933 | A1 * | 12/2008 | Hung | 81/177.8 |

* cited by examiner

*Primary Examiner* — David B Thomas
(74) *Attorney, Agent, or Firm* — Harpman & Harpman

(57) ABSTRACT

A combination ratchet wrench extension tool that provides an integrated extension that can be used with a ratchet wrench or independently as a spinner for manual socket manipulation. A pair of flexible joints on a main body bar, one of which has a square socket head for use with common sockets and an oppositely disposed pivotally secured finger hole engagement spinner fitting with a female port extension or ratchets, extensions and breaker bars.

5 Claims, 4 Drawing Sheets

HIGH SPEED EXTENSION BREAKER BAR

This application claims benefit of Provisional Patent Application Ser. No. 61/215,037, filed May 1, 2009.

BACKGROUND OF THE INVENTION

1. Technical Field

This invention relates to hand tools, specifically ratchet engagement extensions to provide mechanics with an increase socket tool engagement length, speed, spinner and breaker bar for loosening or tightening application tools.

2. Description of Prior Art

Prior art devices of this type are directed to well known ratchet wrench extensions which give the users the option of extending the effective length and reach of a socket for engagement on a working nut or bolt. Prior art applications, for example, can be seen in U.S. Pat. Nos. 6,119,559, 6,186,033, 6,382,058 and U.S. Publication 2002/0078800 A1 all of which disclose a variety of socket wrench extension configurations.

In U.S. Pat. No. 6,119,559, a socket wrench extension is claimed having a flexible joint with a polygon socket head and lateral socket head surface. This allows the socket wrench to be used at an angle orientation from the socket.

U.S. Pat. No. 6,186,003 discloses a multi-positioning turning tool wherein a wrench is provided with a rotatable tool engagement with a snap-on corresponding end fitting.

A multiple joint wrench handle can be seen in U.S. Pat. No. 6,382,058 wherein multiple joints are added to a standard wrench having a head or fastener end working portion. The ratchet socket engagement is in extended axial placement to the ratchet handle by interior adjustable head elements.

Finally, in U.S. Publication 2002/0078800 A1 a socket wrench extension with improved torque transmission is illustrated having a driving column with a releasable end socket engagement including a recessed secured end shoulder.

SUMMARY OF THE INVENTION

An articulated ratchet wrench extension having a main extension body with a first angular adjustment joint and square socket engagement end. A second angular adjustment joint in oppositely disposed relation thereto with a finger spinner opening and female receiving socket end fitting extending therefrom allowing select socket angular engagement in a variety of orientations. Alternate finger spinner fitting with direct socket engagement provides for user selectability thereof.

DETAILED DESCRIPTION OF THE INVENTION

Figure 1:
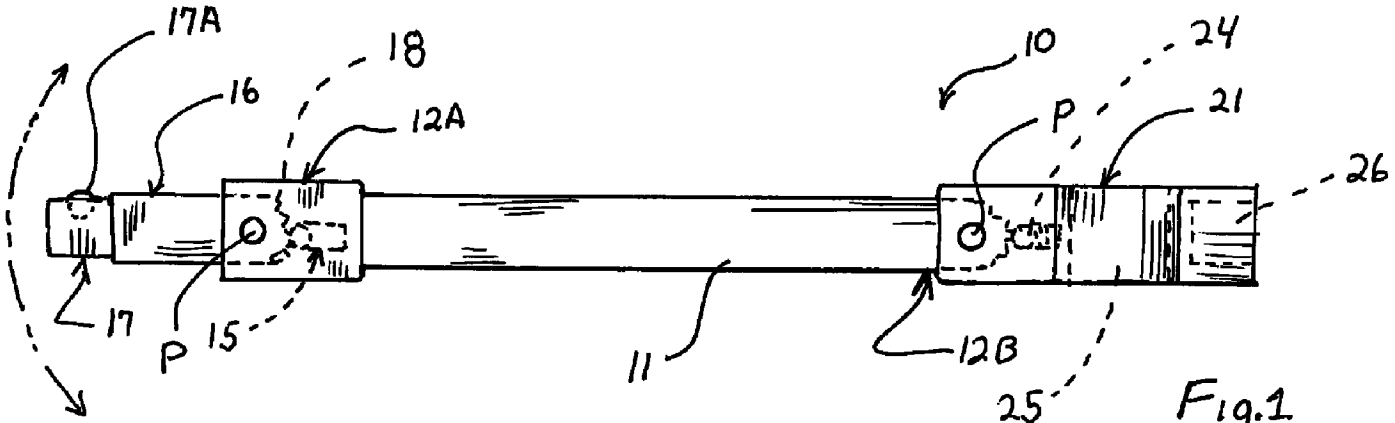
FIG. 1 is a side elevational view of the extension tool of the invention.
Figure 2:
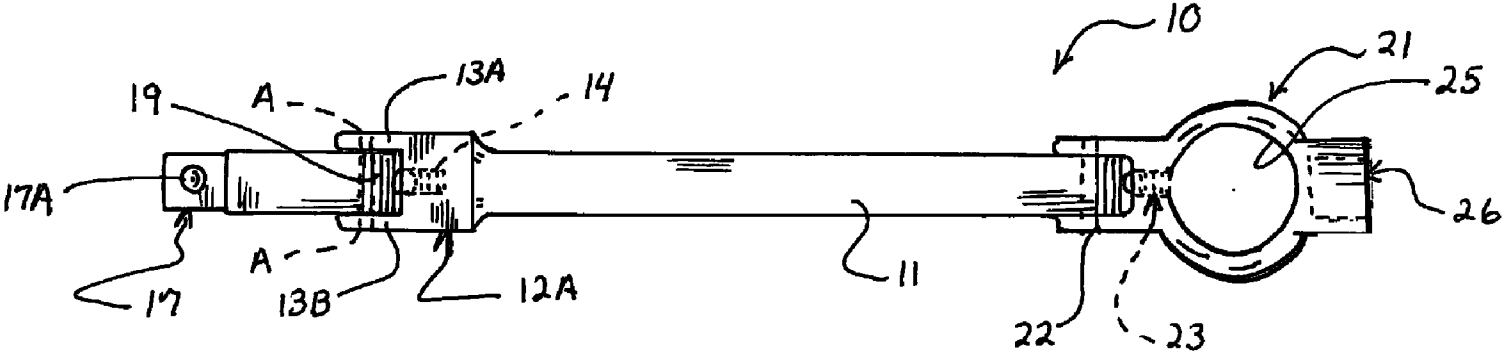
FIG. 2 is a top plan view thereof.

Referring to FIGS. 1 and 2 of the drawings, a ratchet wrench extension 10 of the invention can be seen having a main cylinder body member 11 with a bifurcated end 12A having corresponding spaced parallel arms 13A and 13B with aligned apertures A therethrough.

A receiving bore 14 extends inwardly within the end 12A body member 11 in axial alignment therewith for receiving an indexing spring and ball bearing assembly 15 insert shown in dotted lines as will be described in greater detail hereinafter.

A socket head fitting 16 having a socket engagement end 17 and an indexing stud end 18 with a plurality of transversely oriented ratchet teeth 19 which is pivotally secured between the arms 13A and 13B by a pivot pin P.

The indexing spring and ball bearing assembly 15 holds the socket head fitting 16 in user selected position through a one hundred and eighty degree arcuate positionings indicated by broken line arrow in FIG. 1 of the drawings. The socket head fitting 16 square end engagement portion 17 that will fit a standard socket, not shown, retaining same with a ball bearing detent 17A and mated open pinion well known within the art.

The cylindrical body member 11 has an oppositely disposed transversely apertured ratchet engagement stud end 12B for receiving a spinner head 21 by engagement within having a mounting yoke 22 with aligned apertures A therethrough and a pivot pin P retaining same. The spinner head 21 has an axially aligned receiving bore 23 in which is mounted a corresponding second ball bearing and spring assembly 24 for indexing retention against the ratchet engagement stud end 12B as noted. The spinner head 21 has an enlarged user finger opening 25 with a female socket receiving fitting 26 extending therefrom for receiving ratchet drive wrenches or standard extensions (not shown).

Figure 3:
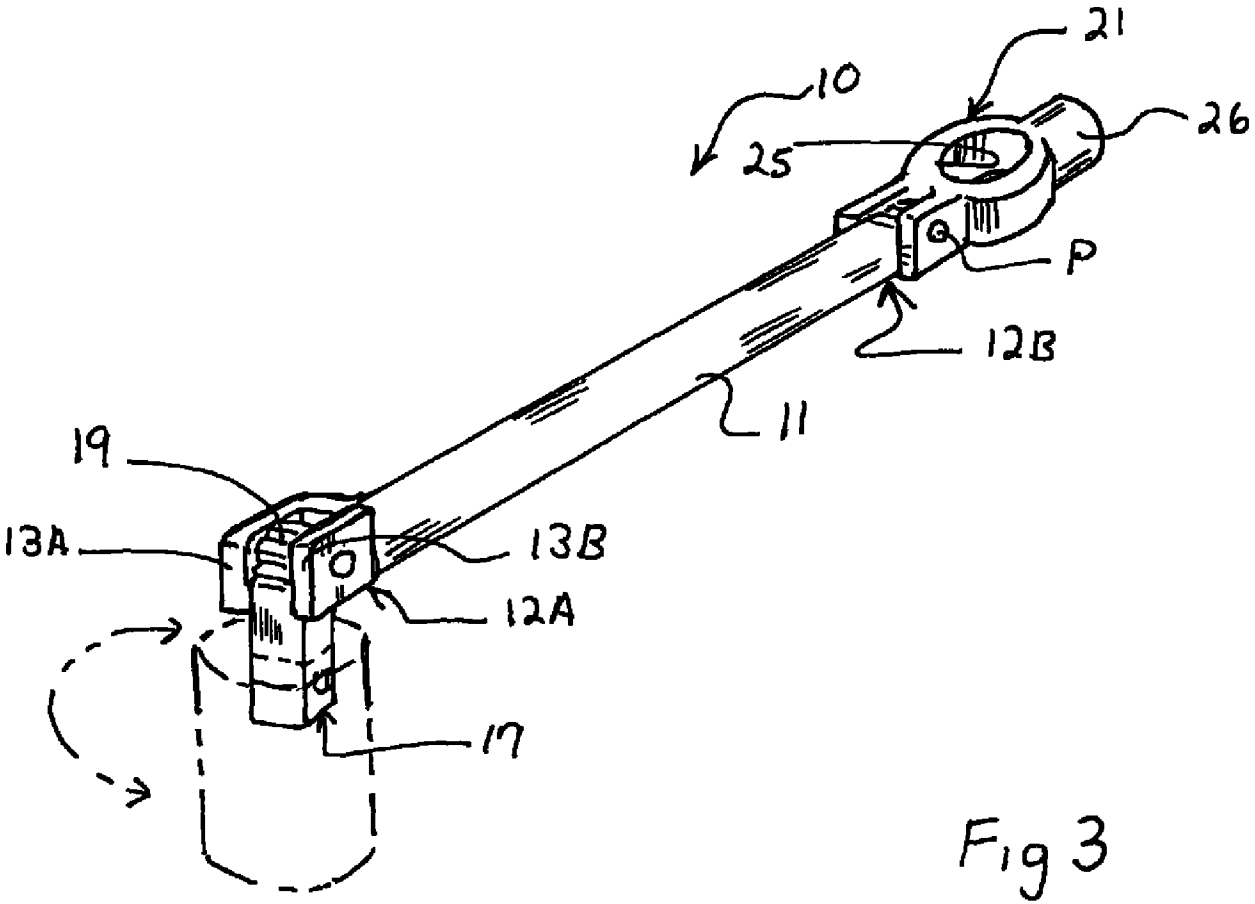
FIG. 3 is a perspective view of the extension tool in operation.
Figure 4:
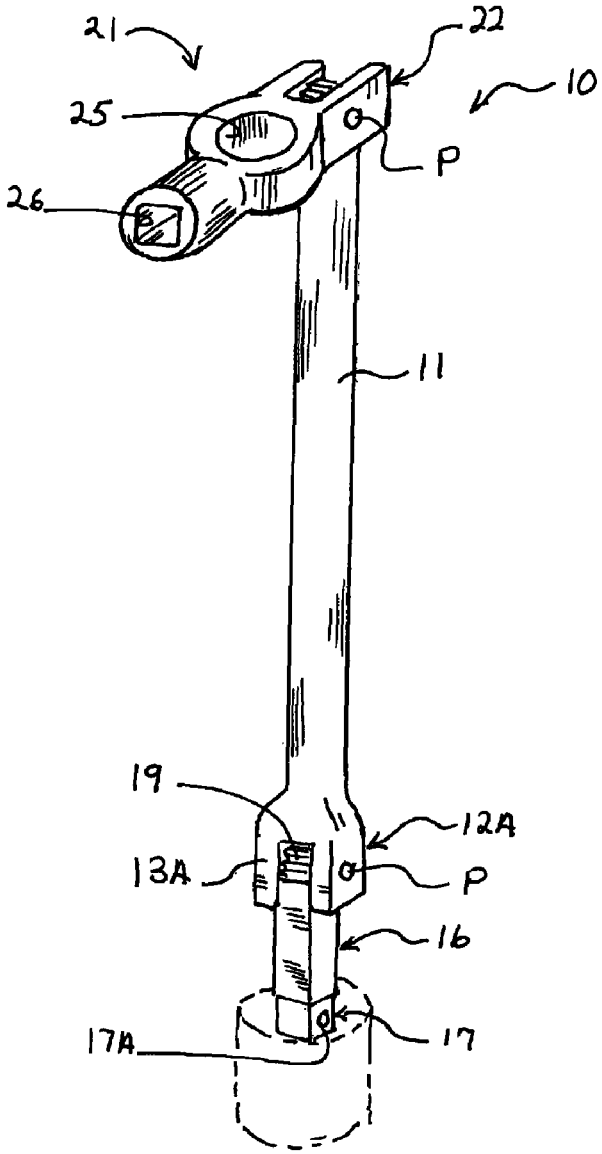
FIG. 4 is a perspective view of the extension tool and alternate operational mode.

It will be evident from the above description that both the socket head fitting 16 and the spinner head fitting 21 can be pivotally adjusted sequentially through a one hundred and eighty degree positioned arc relative the cylinder body respective ends 12A and 12B onto which they are so mounted which affords a variety of user variable positions as illustrated in FIGS. 3 and 4 of the drawings with a fastener engagement socket 20 shown in broken lines as an example of positioning orientation of the socket head relative to the cylindrical body member 11.

Figure 5:
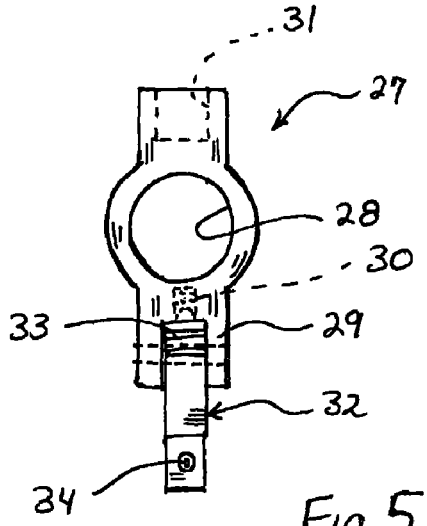
FIG. 5 is a top plan view of an alternate articulated end tool fitting.
Figure 6:
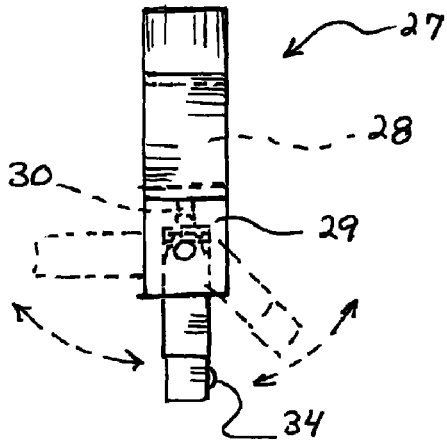
FIG. 6 is a side elevational view thereof.

Referring now to FIGS. 5 and 6 of the drawings, an alternate spinner head 27 can be seen having an enlarged finger receiving opening 28 with a mounting yoke 29 and third ball bearing and spring index retaining assembly 30 therewithin. A female receiving socket 31 extends therefrom corresponding to the hereinbefore described primary spinner head 21 as noted.

The alternate spinner head 27 has a socket head engagement portion 32 with an apertured ratchet end 33 pivotally secured within the yoke 29 selectively retained by the ball bearing and spring assembly 30. The socket engagement 32's free end has as set forth in the primary form of the invention a ball bearing detent at 34 to retain a working socket allowing for selective locking adjustment through the one hundred and eighty degree orientation indicated by broken lines in FIG. 6 of the drawings.

Figure 7:
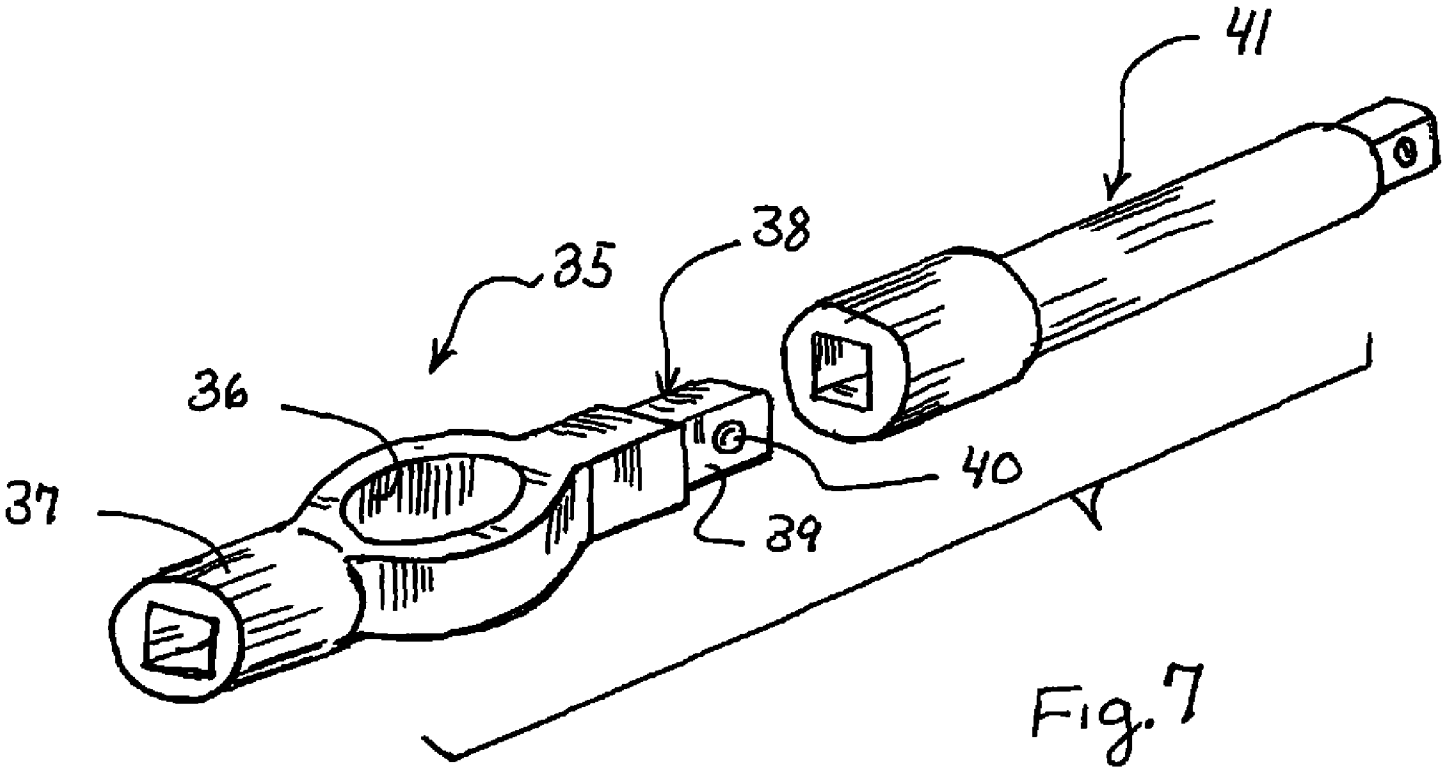
FIG. 7 is an exploded perspective view of a second alternate non-articulated end tool spinner fitting.

Referring now to FIG. 7 of the drawings, an exploded perspective view of a second alternate form of the primary spinner head 21 can be seen. An alternate spinner head 35 has a corresponding enlarged central finger engagement portion 36 with a female socket receiving extension 37 extending therefrom in place of the primary yoke 28. A fixed socket head extension 38 extends in oppositely disposed relation for the finger engagement opening 36 with a transversely reduced square end 39 having a ball bearing detent 40. A socket extension bar 41 is illustrated for engagement, in this example, therewith which would be applied in some user venues providing the spinner head engagement to be utilized as necessary.

It will thus be seen that the ratchet wrench extension 10 of the invention performs several functions that regular or common extension bars cannot accomplish. One variation comes when the mechanic needs to quickly put on or take off multiple nuts or bolts. For use as a high speed spinner application, the user simply flips the spinner head 21 to a ninety degree position and inserts their finger in the enlarged user finger receiving opening 25 and holds the main cylinder shaft 11 with the other hand and rapidly turns the spinner head 21 in the desired direction as seen in FIG. 4 of the drawings. Another variation of this tool is when a deep reach breaker bar is needed by placing the spinner head 21 in the ninety degree position, inserting a common six inch extension (not shown) into the female socket receiving fitting 26 with the male socket head fitting 16 positioned in axial alignment and a socket attached, the user can then pull the inserted extension like a handle and has a deep reach breaker bar for installation removal of items.

It will be evident that a variety of other position and orientations can be achieved that will correspond to user requirements in the field and are possible by the combination and adaptability of the ratchet wrench extension 10 of the invention with its oppositely disposed user selective positioning socket head fitting 16 and spinner head 21 and variations as hereinbefore described.

It will thus be seen that a new and novel ratchet wrench extension 10 has been illustrated and described and it will be apparent to those skilled in the art that various changes and modifications may be made thereto without departing from the spirit of the invention.

Therefore I claim:

1. A ratchet wrench extension having multiple work engagement positions comprises, an elongated extension body member having a stud end and a bifurcated end, a socket head fitting having a stud end and a socket engagement end pivotally secured in said bifurcated end, a spinner head fitting having a central finger engagement opening, a female socket receiving end and a yoke end, an indexing spring urged ball bearing in said respective bifurcated and yoke ends, each of said respective stud ends having transverse teeth registerably engaged by said respective indexing spring urged ball bearings locking said socket head fitting and said spinner head fitting in selective angular positions relative thereto.

2. The ratchet wrench extension set forth in claim 1 wherein said socket head fitting socket engagement end having a socket retaining spring urged detent thereon.

3. The ratchet wrench extension set forth in claim 1 wherein said socket head fitting and said spinner head fitting are pivotally secured to said respective ends of said extension body member by pivot pins extending through aligned apertures therewithin.

4. A ratchet wrench extension having multiple work engagement positions comprises, an elongated extension body member having a stud end and an apertured ratchet stud end, a spinner head fitting having a central finger engagement opening, a female socket receiving end and a yoke end, and a socket head fitting within said yoke end, an indexing spring urged ball bearing in said yoke end and wherein said stud end has a socket retainment spring urged detent.

5. A ratchet wrench extension having multiple work engagement portions comprises an elongated socket extension body member having a stud end and a female socket receiving end, a spinner head fitting having a central finger engagement opening, a female socket receiving end and a fixed socket head fitting in oppositely disposed relation thereto selectively secured within said female socket receiving end of said socket extension body member wherein said stud end and said fixed socket head fitting have socket retainment spring urged decent therewithin.

* * * * *